US008888182B2

(12) United States Patent
Ivicevic

(10) Patent No.: US 8,888,182 B2
(45) Date of Patent: Nov. 18, 2014

(54) RECLINING CHAIR

(71) Applicant: Dragomir Ivicevic, New York, NY (US)

(72) Inventor: Dragomir Ivicevic, New York, NY (US)

(73) Assignee: Synergy Product Development, Inc., Grand Rapids, MI (US)

( * ) Notice: Subject to any disclaimer, the term of this patent is extended or adjusted under 35 U.S.C. 154(b) by 0 days.

(21) Appl. No.: 14/059,275

(22) Filed: Oct. 21, 2013

(65) Prior Publication Data

US 2014/0042788 A1 Feb. 13, 2014

Related U.S. Application Data

(63) Continuation of application No. 12/415,684, filed on Mar. 31, 2009, now abandoned.

(51) Int. Cl.

| | |
|---|---|
| ***A47C 3/025*** | (2006.01) |
| ***A47C 1/023*** | (2006.01) |
| ***A47C 1/024*** | (2006.01) |
| ***A47C 1/032*** | (2006.01) |
| ***A47C 3/023*** | (2006.01) |
| ***A47C 3/04*** | (2006.01) |
| ***A47C 7/46*** | (2006.01) |

(52) U.S. Cl.

CPC ..... *A47C 1/023* (2013.01); *A47C 1/024* (2013.01); *A47C 1/03272* (2013.01); *A47C 1/03277* (2013.01); *A47C 3/023* (2013.01); *A47C 3/04* (2013.01); *A47C 7/46* (2013.01); *A47C 1/0325* (2013.01)

USPC ..... 297/294; 297/287; 297/317; 297/322

(58) Field of Classification Search

USPC ..... 297/285, 287, 317, 320, 322, 288, 294, 297/295; 267/131, 133

See application file for complete search history.

(56) References Cited

U.S. PATENT DOCUMENTS 2,638,149 A * 5/1953 Janosek ..... 297/287
6,722,735 B2 * 4/2004 Lucci et al. ..... 297/320 X

* cited by examiner

*Primary Examiner* — Anthony D Barfield
(74) *Attorney, Agent, or Firm* — Kane & Co., PLC

(57) ABSTRACT

In the specification and drawings a chair is described and shown with a resiliently flexible frame having a front seat support; a seat slidably engaged to the front seat support; and a back rotatably engaged to the frame, the back being rotatably engaged to the seat.

15 Claims, 13 Drawing Sheets

RECLINING CHAIR

CROSS REFERENCE TO RELATED APPLICATION

This is a continuation application of U.S. patent application Ser. No. 12/415,684 filed on Mar. 31, 2009, now abandoned.

BACKGROUND OF THE INVENTION

1. Field of the Invention

An embodiment disclosed herein is generally directed to a simplified design for a synchronized reclining chair.

2. Discussion of the Related Art

The application of scientific information to the design of objects, systems and environments for human use has resulted in a revolution in the seating industry. Typically, the cost of applying the scientific information was economical in only the more expensive types of seating (e.g., executive office chairs). The more affordable chairs were designed more for affordability and durability than for the comfort of the user. As more is learned about the operation of the human body and through technological advances, user comfort is increasingly becoming a design priority for all chairs.

An embodiment disclosed herein is directed to an affordable, durable chair which also addresses many of the problems associated with the related art, namely user comfort.

BRIEF DESCRIPTION OF THE DRAWINGS FIGURES

DETAILED DESCRIPTION OF THE EMBODIMENTS DEPICTED

Figure 13:
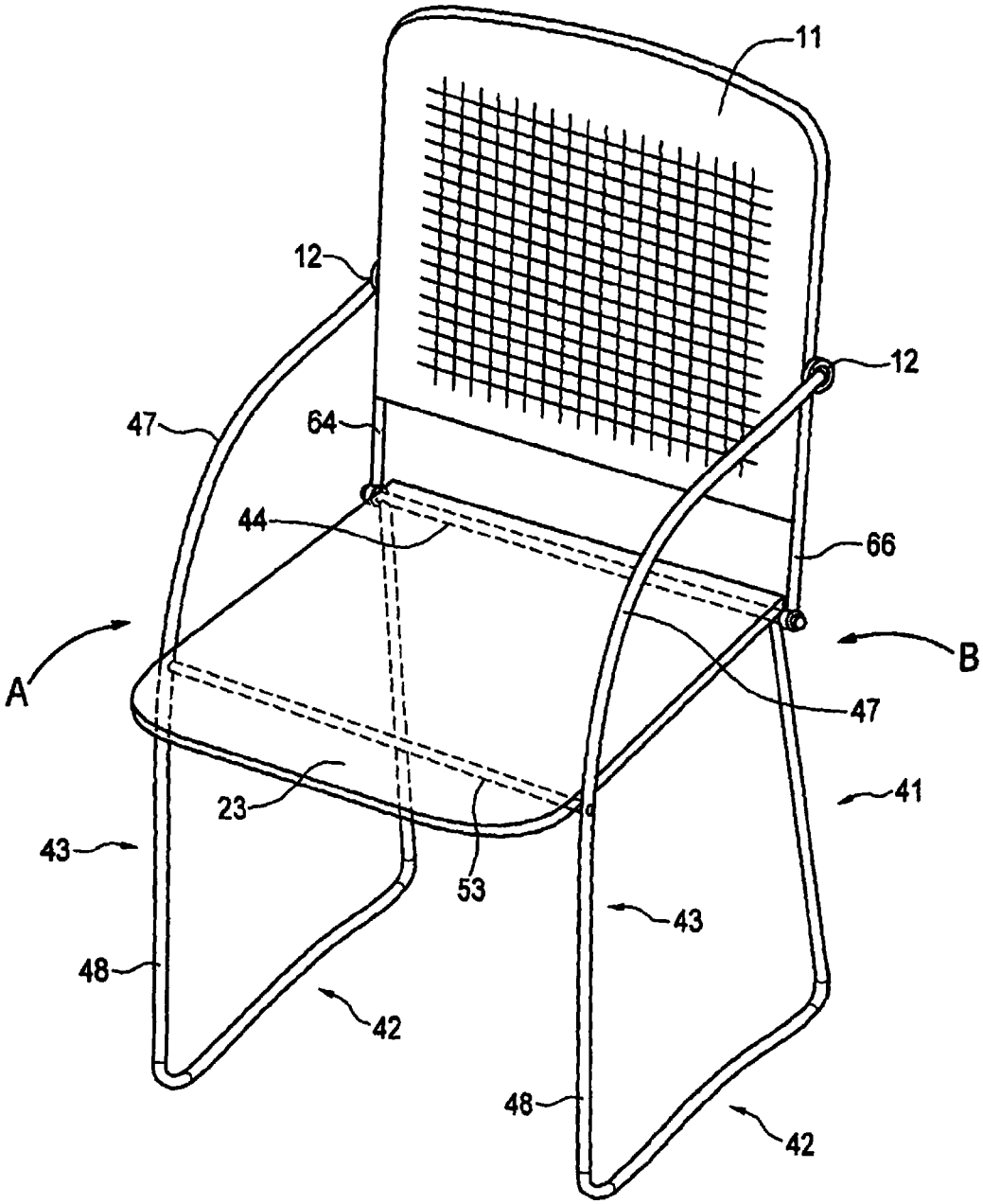
FIG. 13 is an illustration of a perspective view of an embodiment of the present invention.

For the purposes of description herein, the terms "left" and "right" and derivatives hereof shall relate to the embodiment as oriented in FIG. 13, with reference letter "A" depicting the left and reference letter "B" depicting the right. The terms "front" and "rear" and derivatives hereof shall relate to the embodiment as oriented in FIG. 1, with reference letter "C" depicting the front and reference letter "D" depicting the rear. However, it should be understood by one skilled in the art that the invention will assume various alternative orientations, except where expressly specified to the contrary. It should also be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

An embodiment disclosed herein provides a simplified design for a reclining chair 1. Referring to the embodiment shown in FIG. 3, the chair 1 can comprise a back 11, a seat 23 and a frame 40. The back 11 can comprise an ergonomic backrest such as a mesh chair component of the type more fully described in U.S. Pub. No. 2005/0264087 entitled "Mesh Chair Component," which is incorporated herein by reference, or components of the type more fully described in U.S. Pub. No. 2007/0222268 entitled, "Ergonomic Side Chair," also incorporated herein by reference. The seat 23 may also comprise an ergonomic seat such as a mesh chair component of the type more fully described in U.S. Pub. No. 2005/0264087 entitled, "Mesh Chair Component," which is incorporated herein by reference, or components of the type more fully described in U.S. Pub. No. 2007/0222268 entitled, "Ergonomic Side Chair," also incorporated herein by reference. One skilled in the art should appreciate that the seat 23 and the back 11 may comprise a variety of forms and materials, including but not limited to, textiles, plastics, thermoplastics, composite fibers, or any other suitable materials.

Figure 1:
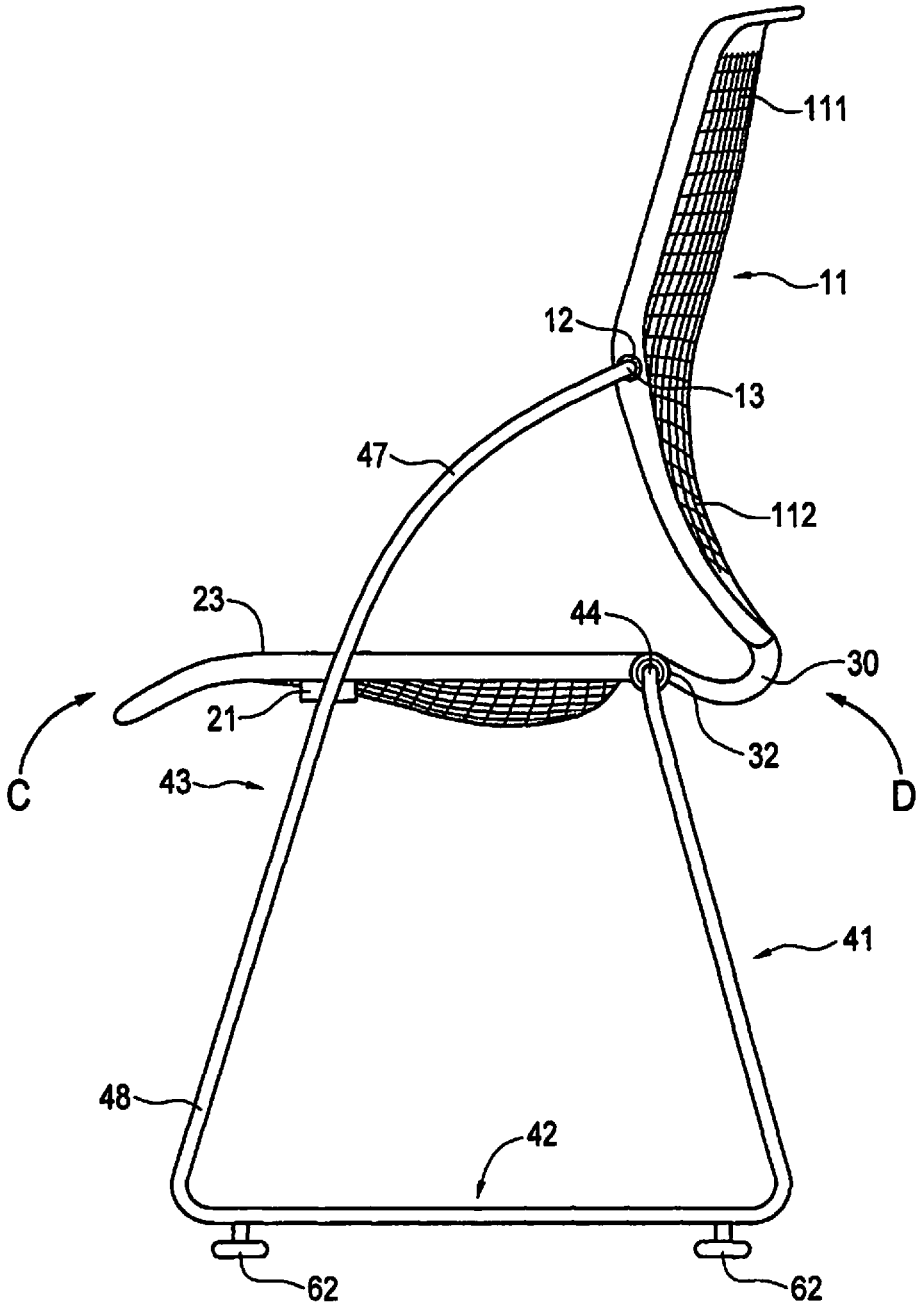
FIG. 1 is an illustration of a right side view of one embodiment of the present invention.
Figure 3:
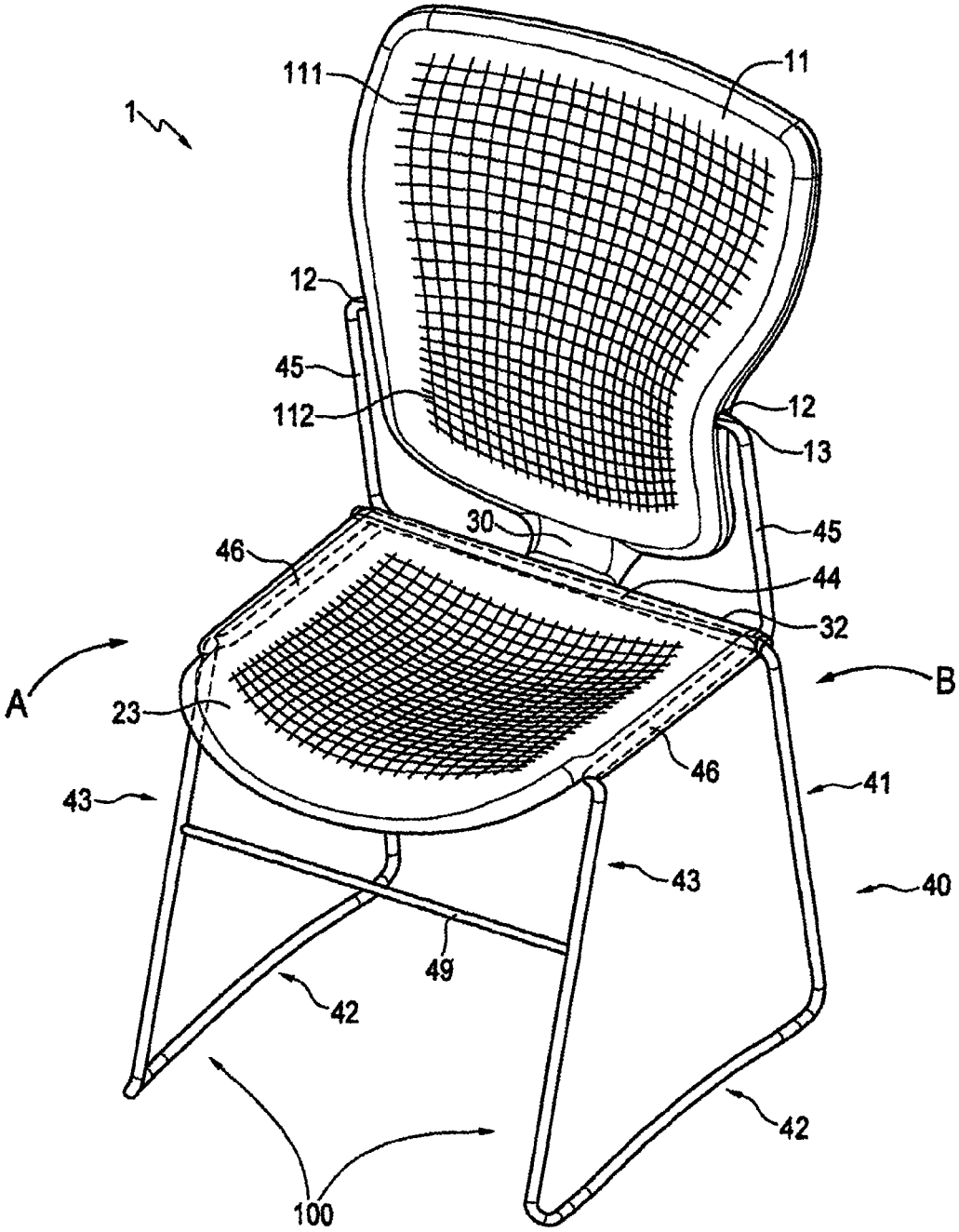
FIG. 3 is an illustration of a perspective view of another embodiment of the present invention.

As shown in the embodiment depicted in FIG. 3, the frame 40 can comprise a one-piece, continuous member defining a left and right frame portion 100 and a central portion 44. In other embodiments, the frame 40 may comprise separate portions which are interconnected. The separate portions can be interconnected by any means in the art, including but not limited to, welding, the utilization of fasteners, or adapting the ends of the members with screw threads. Still referring to FIG. 3, the left frame portion 100 can have a left front leg portion 43, a left base portion 42, and a left rear leg portion 41. The right frame portion 100 can have a right front leg portion 43, a right base portion 42, and a right rear leg portion 41. As shown in FIG. 1, the front leg portions 43 can further define left and right armrest sections 47 and left and right support sections 48.

The frame 40 can comprise a resiliently flexible material, such that the frame 40 functions as a spring. The resiliently flexible material can be a metallic or semi-metallic material such as steel and aluminum, capable of absorbing energy when it is deformed elastically, and then upon unloading, to have this energy recovered. Polymers, including plastics, plastic composites, and fiber-reinforced plastics, can also be used, as well as any other suitable material. The frame 40 can be in the form of cylindrical tubing, as shown in the embodiments depicted in FIGS. 1-7. The frame can also be in the form of a square or rectangular tubing, round, square, or flat bar or any other shape in the art.

Figure 2:
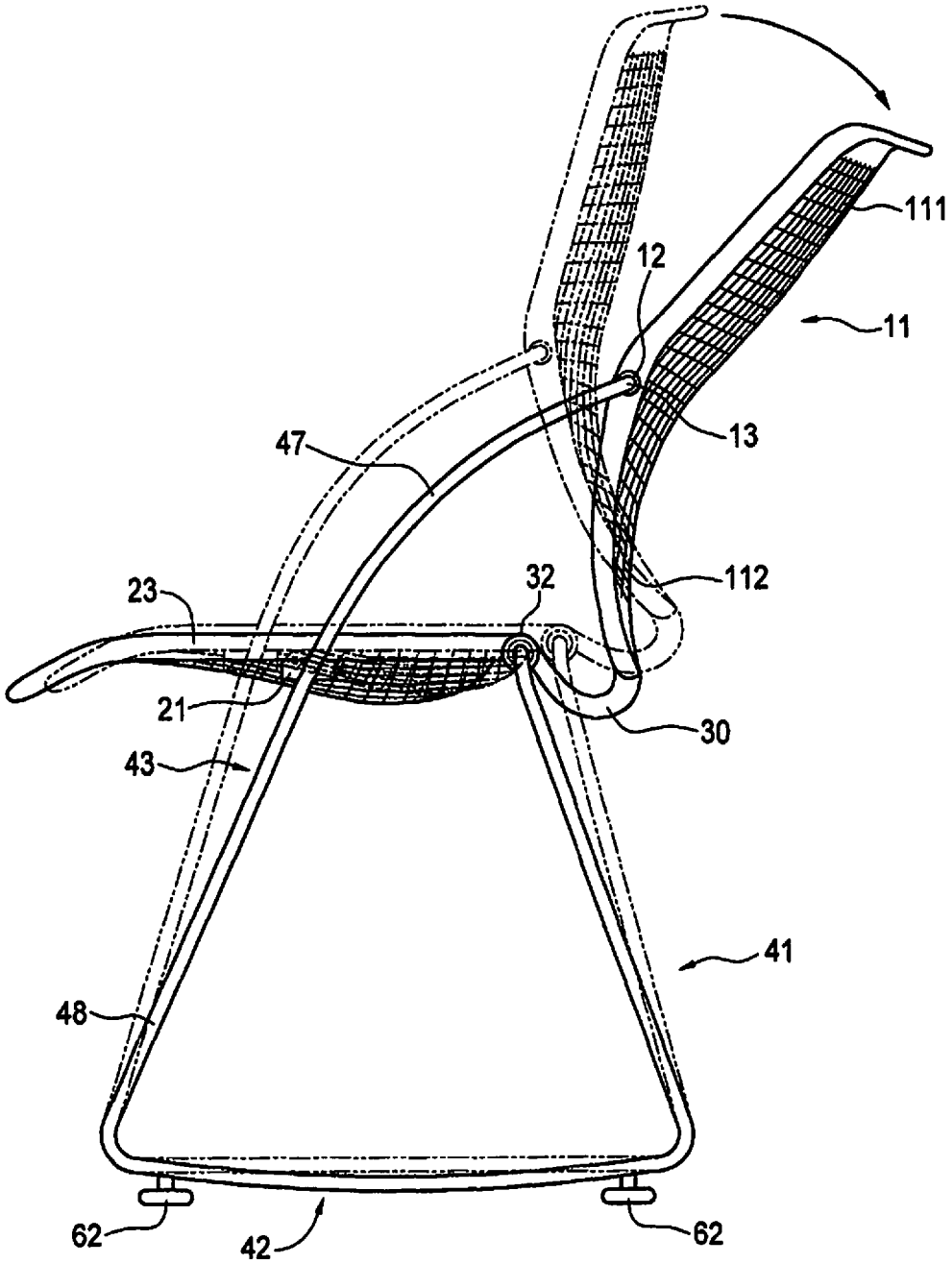
FIG. 2 is an illustration of a right side view of the embodiment shown in FIG. 1 in its reclined position.

Referring to the embodiment in FIGS. 1 and 2, the back 11 is rotatably engaged to the front leg portion 43 of the frame. The back 11 further comprises an upper back portion 111 and a lower back portion 112. In an embodiment, the back 11 comprises two recesses, a left pivot recess 12 and a right pivot recess 12, upon which the back 11 may be rotatably engaged to the frame 40 of the chair at upper pivot point 13. The back 11 is also rotatably engaged to the seat 23. In the embodiment depicted in FIG. 6, the back 11 is rotatably engaged to the seat 23 by the back 11 being rotatably connected to the seat 23 at pivot point 24. In an embodiment, one or more connectors 30 can join the back 11 and the seat 23 such that the connectors 30 are fixed to the lower back portion 112 and rotatably connected to the seat 23 at one or more seat pivot point(s) 24. In another embodiment, the connector can be constructed of a flexible material, thereby allowing the connector 30 to be fixed to both the back 11 and the seat, yet still maintain the rotatable engagement of back 11 to the seat 23. In yet another embodiment, the connector can comprise multiple sections, with one or more of the sections being 10 rotatably connected to another section. In this embodiment, the connector 30 can be fixed to both the back 11 and the seat, yet the back 11 will remain rotatably engaged to the seat 23. In an embodiment, the connector 30 can be a separate component from the back 11. In another embodiment, the connector 30 can be integral with the back 11 and can simply be an extension of the back 11.

As shown in the embodiment depicted in FIG. 13, the back 11 can be rotatably engaged to the seat 23 by left connector 64 and right connector 66. As shown in FIG. 13, left connector 64 and right connector 66 can be rotatably connected to the rear leg portions 41 of the frame 40. Specifically, left connector 64 is rotatably connected to the left rear leg portion of the frame 40, and right connector 66 is rotatably connected to the right rear leg portion of the frame 40. As the seat 23 can also be rotatably connected to the rear leg portions 41 of the frame 40 and/or a central portion 44 of the frame 40, the seat 23 can be rotatably engaged to the back 11 via left connector 64 and right connector 66 being rotatably connected to the left rear leg portion and the right rear leg portion of the frame 40 respectively. Although left connector 64 and right connector 66 are shown in FIG. 13 as being rotatably connected to the left rear leg portion and right rear leg portion of the frame 40 respectively, left connector 64 and right connector 66 can alternatively be rotatably connected to the seat 23 and/or rotatably connected to a central portion 44 of the frame 40. In each of these embodiments, the back 11 is rotatably engaged to the seat 23.

As shown in the embodiments depicted in FIGS. 1-5, the seat 23 can further comprise a pivot tube 32 integral to the seat 23. A connector 30 can join the back 11 and the seat 23 such that the connector 30 is fixed to the back 11 and rotatably engaged to the pivot tube 32 to form the seat pivot point 24. The central portion 44 of the frame 40 can reside within the pivot tube 32 such that movement of the seat 23 forward causes the left and right rear leg portions 41 to move in conjunction with the central portion 44. In another embodiment, the central portion 44 can be replaced with a short extension or stub connected to the left and right rear leg portions 41, such that the short extensions or stubs rotatably engage the pivot tube 32.

The frame 40 can further comprise a front seat support(s), whereby the seat 23 is slidably engaged to the front seat support(s). The front seat supports can be the frame itself, a protrusion 21, a crossbar 53, or a bracket 300. The front seat supports can provide frictional resistance to the sliding of the seat 23. The front seat support may further comprise any other means in the art such that the seat 23 slides along the front seat support in a manner that adjusts to the weight of the user, such as with friction and the like. In another embodiment, the frame 40 can further comprise both a front seat support(s) and a rear seat support(s), whereby the seat 23 is rotatably engaged to the rear seat support(s) and slidably engaged to the front seat support(s). The rear seat support can comprise the central portion 44 and/or the rear leg portion 41. The rear seat support can also comprise a protrusion or bracket attached to the left and right frame portions 100 and rotatably engaged to the seat 23.

In FIGS. 1 and 2, the front seat support is a protrusion 21. The seat 23 slidably engages the left and right protrusions 21. The right protrusion can be rotatably engaged to the right frame portion 100, and the left protrusion can be rotatably engaged to the left frame portion 100. The rotatable engagement of the protrusions to the frame portions maybe effected by collars, hinges, and the like.

Figure 4:
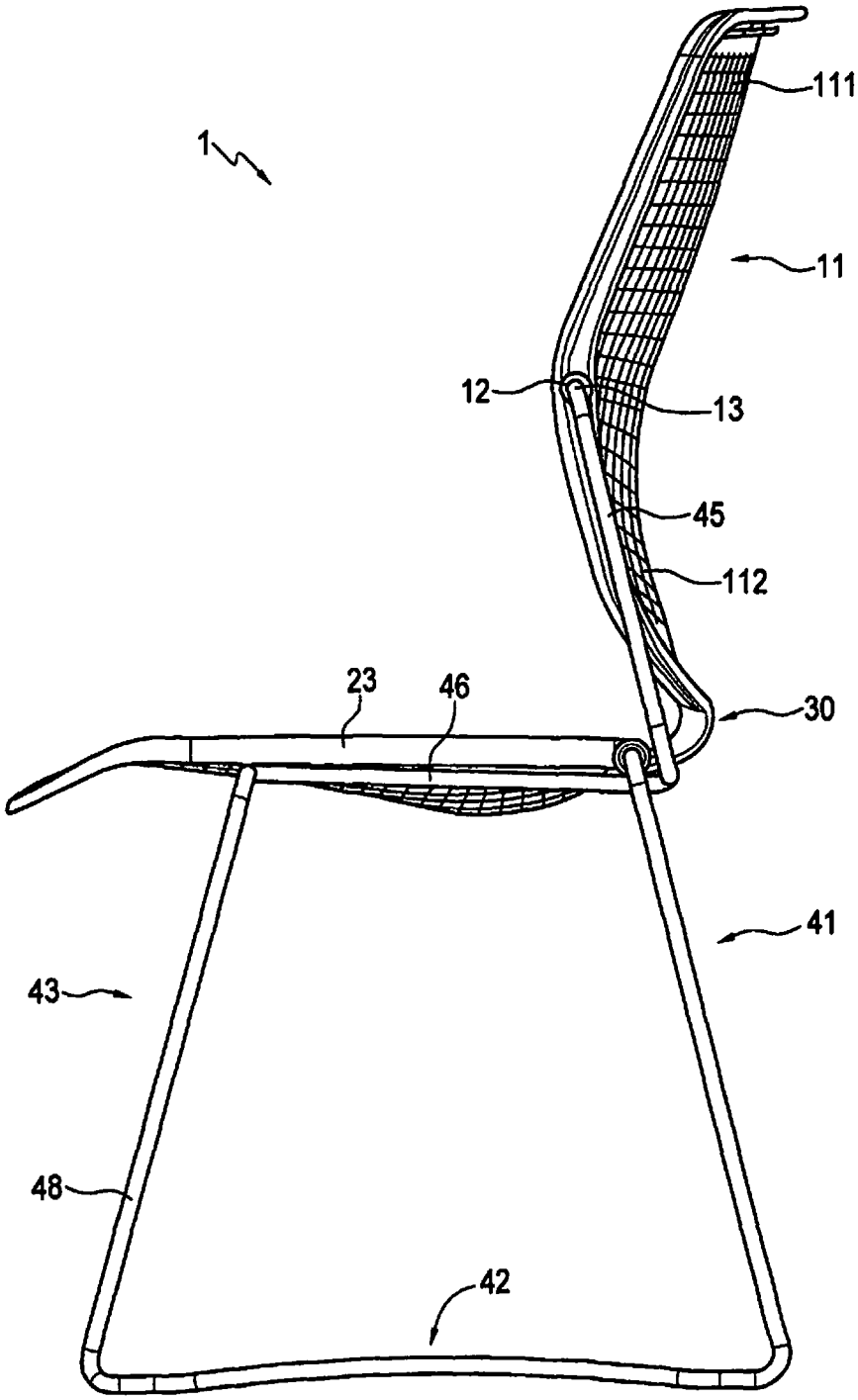
FIG. 4 is an illustration of a right side view of the embodiment shown in FIG. 3.
Figure 5:
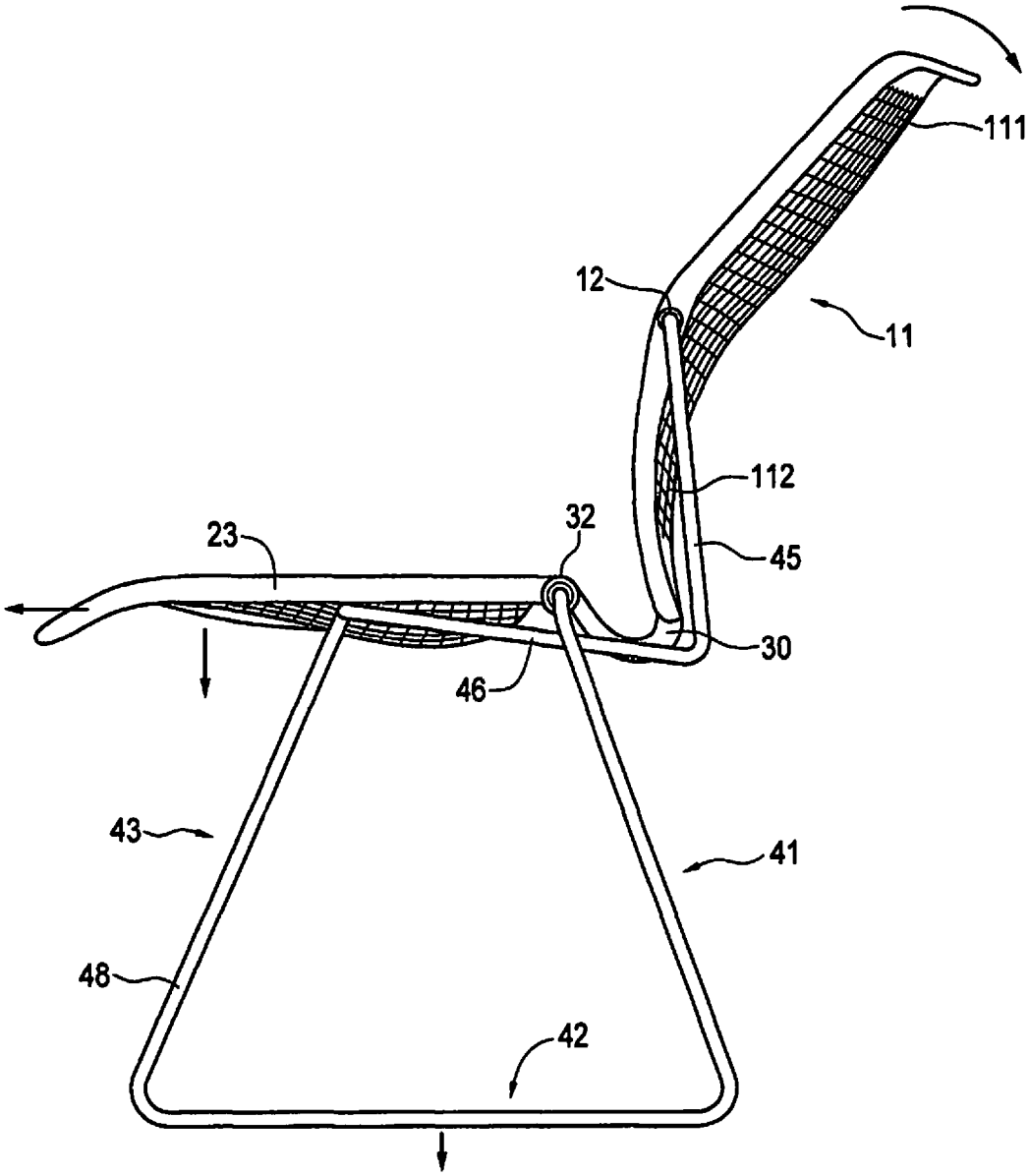
FIG. 5 is an illustration of a right side view of the embodiment shown in FIG. 3 in its reclined position.

In FIGS. 3-5, the front seat support is the frame itself; i.e., the left front seat support is the left frame portion 100 and the right front seat support is the right frame portion 100. In this embodiment, the seat 23 slidably engages the left and right frame portions 100.

Figure 6:
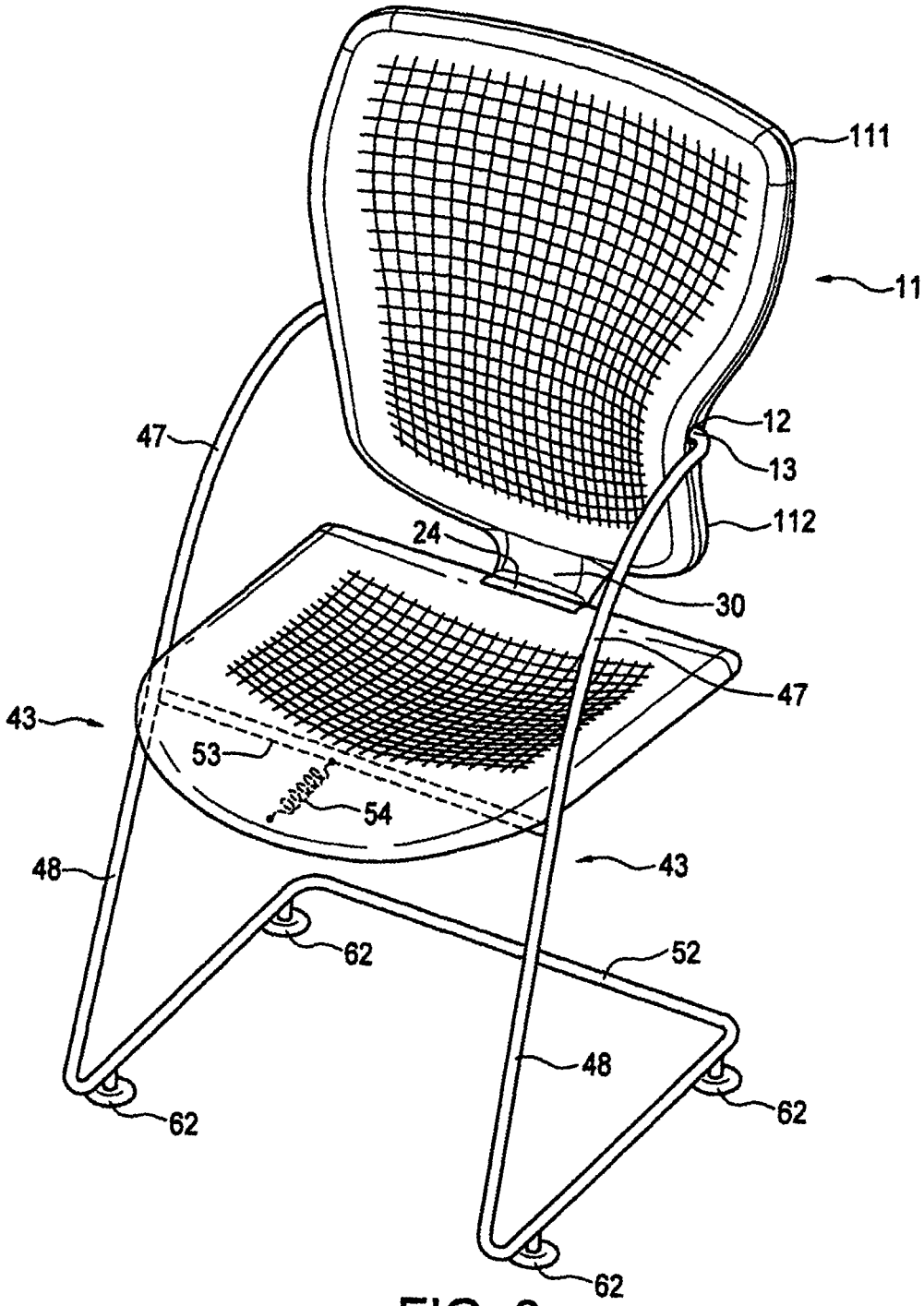
FIG. 6 is an illustration of a right side view of yet another embodiment of the present invention.
Figure 7:
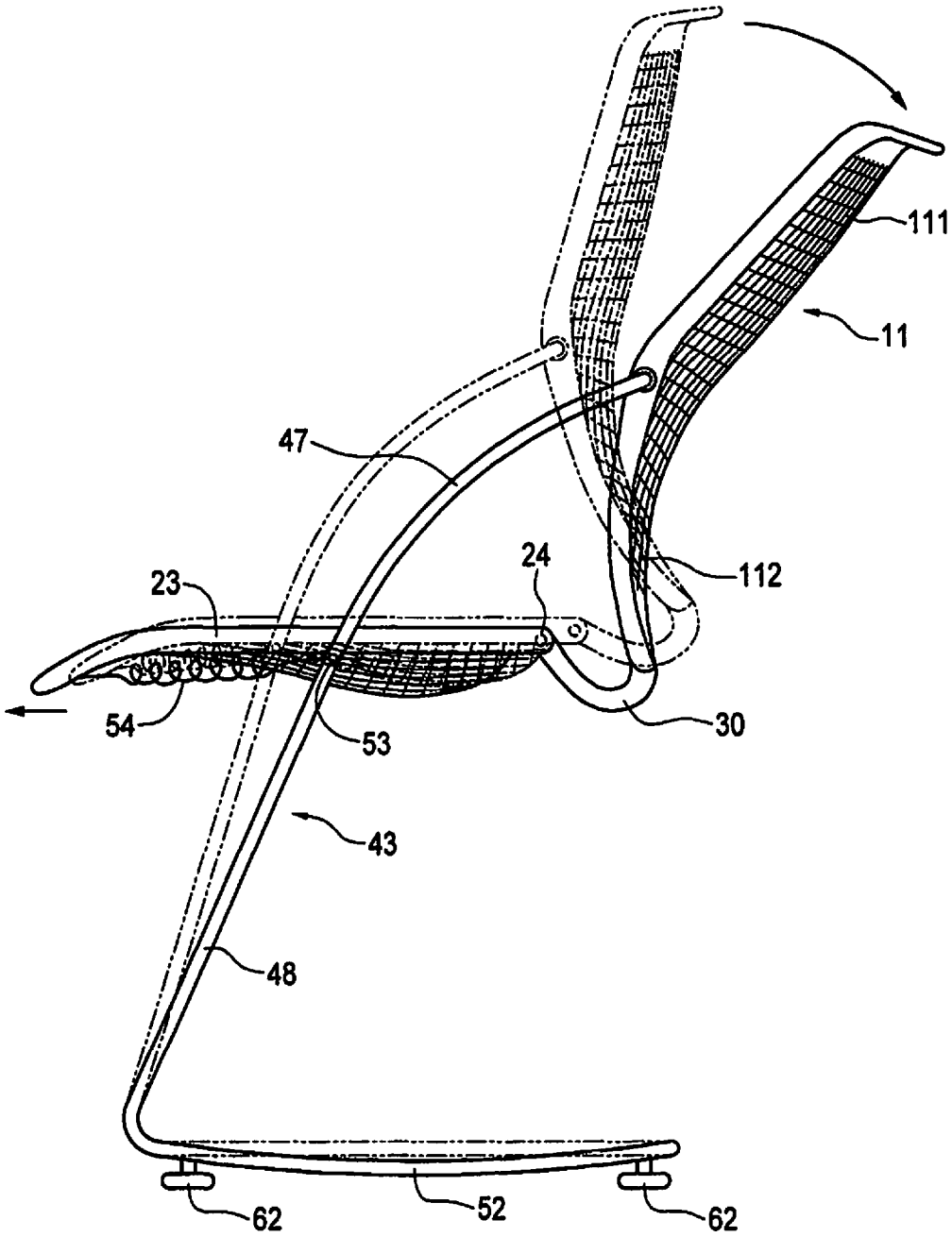
FIG. 7 is an illustration of a right side view of the embodiment shown in FIG. 6 in its reclined position.
Figure 8:
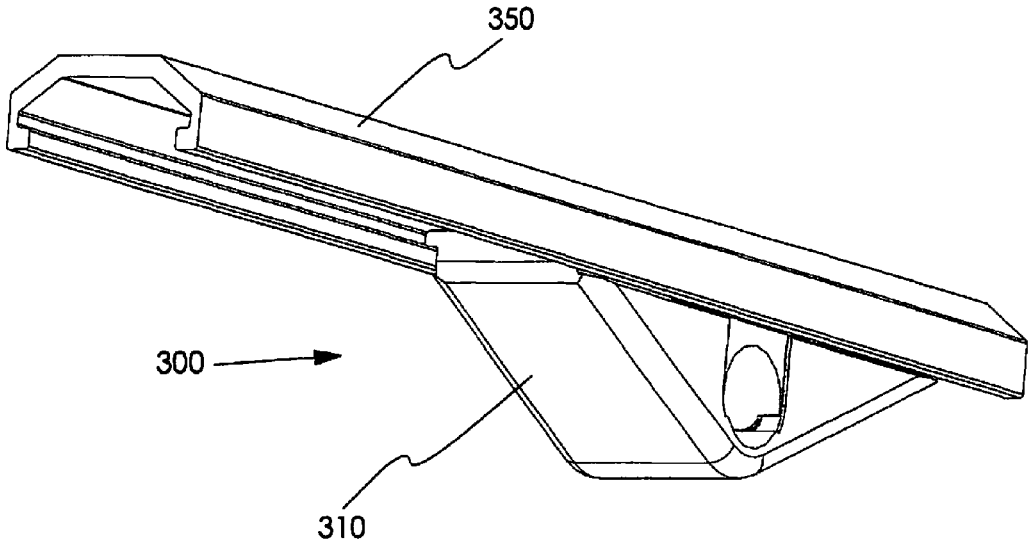
FIG. 8 is an illustration of a perspective view of one embodiment of a bracket.
Figure 9:
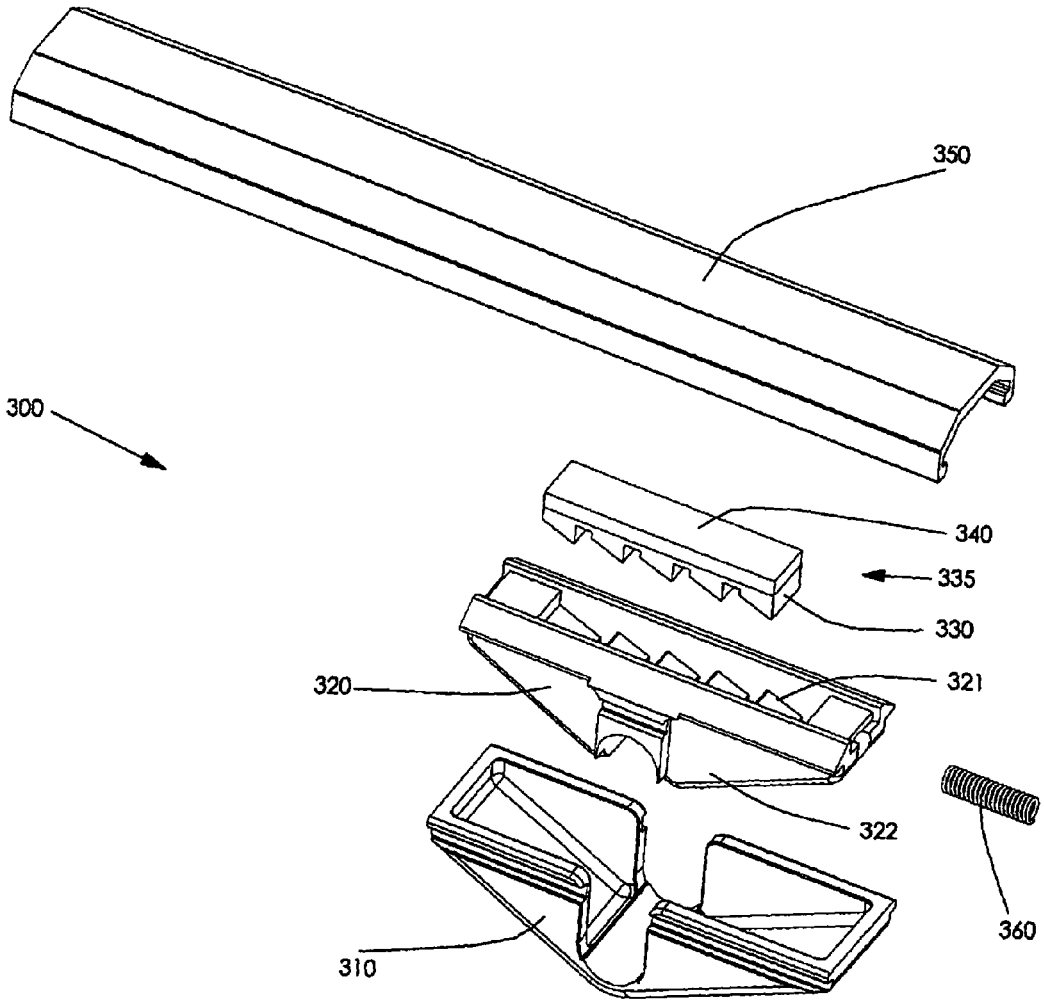
FIG. 9 is an exploded view of an embodiment of a bracket.
Figure 10:
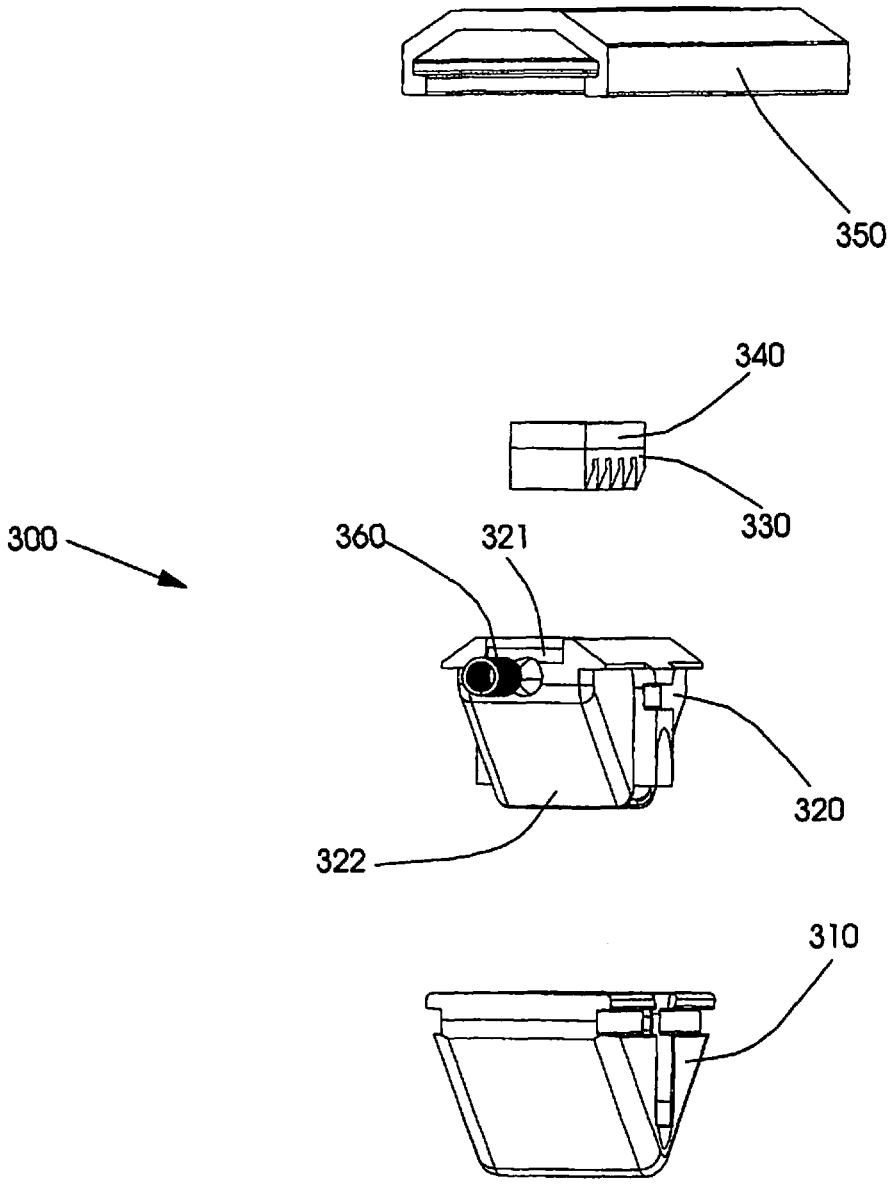
FIG. 10 is another exploded view of an embodiment of a bracket.

In FIGS. 6 & 7, the front seat support is a crossbar 53. The crossbar 53 is connected to the left and right front leg portions 43 of the frame 40. The crossbar 53 slidably engages the bottom surface of seat 23.

Bracket 300, as shown in FIGS. 8-12, can also be a front seat support. Bracket 300 can comprise a lower collar 310, an upper collar 320, and a friction pad 335. The friction pad 335 can comprise an upper portion 340 and a lower portion 330. A left side bracket 300 can rotatably engage the left frame portion 100, and a right side bracket 300 can rotatably engage the right frame portion 100. The lower collars 310 and upper collars 320 are adapted to connect to one another so as to rotatably engage brackets 300 to the left and right frame portions 100. In the embodiments depicted in FIGS. 8-11, the upper collar 320 slidably engages lower collar 310. In an alternative embodiment, the lower and upper collars can be connected with fasteners. In still another embodiment, the lower collar 310 can be eliminated and the lower curved portion of upper collar 320 can simply clip onto the frame portion 100.

The upper collar further defines a top portion 321 and a bottom portion 322. The bottom portion 322, when adjoined to the lower collar 310, rotatably engages the frame portion 100. The top portion 321 comprises a cavity adapted to receive the friction pad 335. The top portion 321 can have one or more wedges protruding upward along at least a portion of the top portion 321's cavity. The friction pad 335 has one or more wedges protruding downward along at least a portion of the friction pad's surface.

Figure 11:
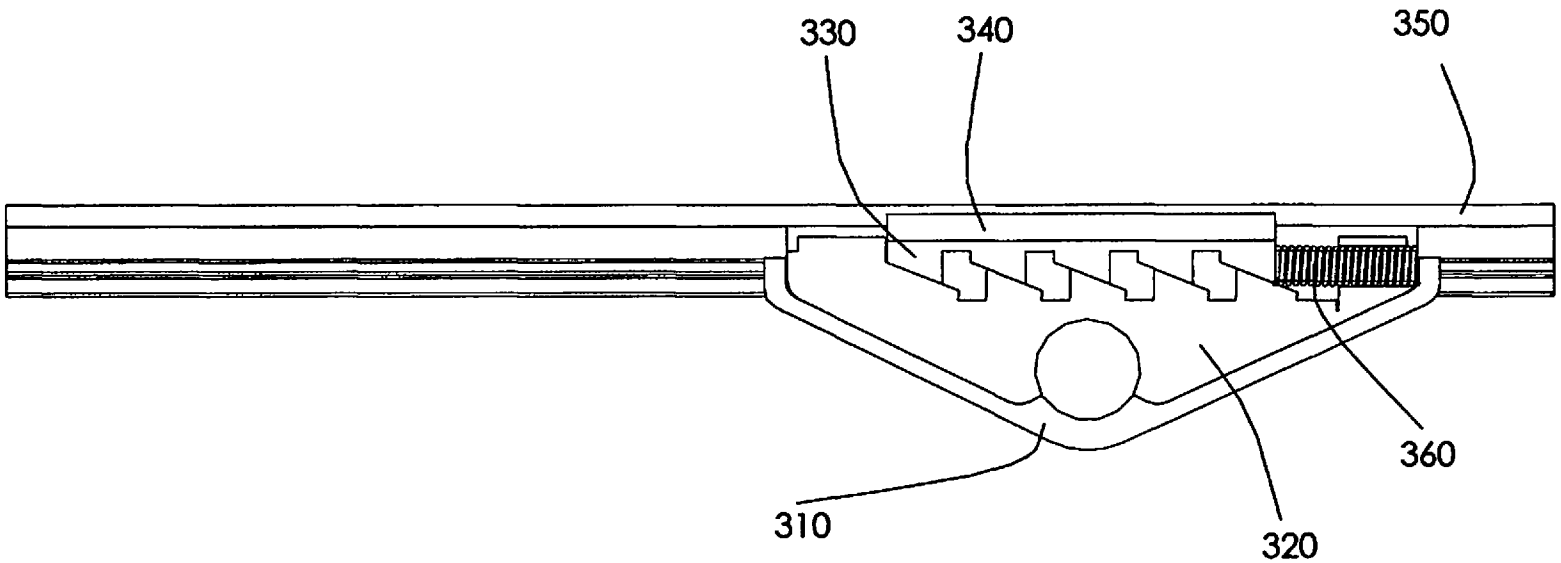
FIG. 11 is a partial cutaway side elevation of an embodiment of a bracket when the chair is in a reclined position.
Figure 12:
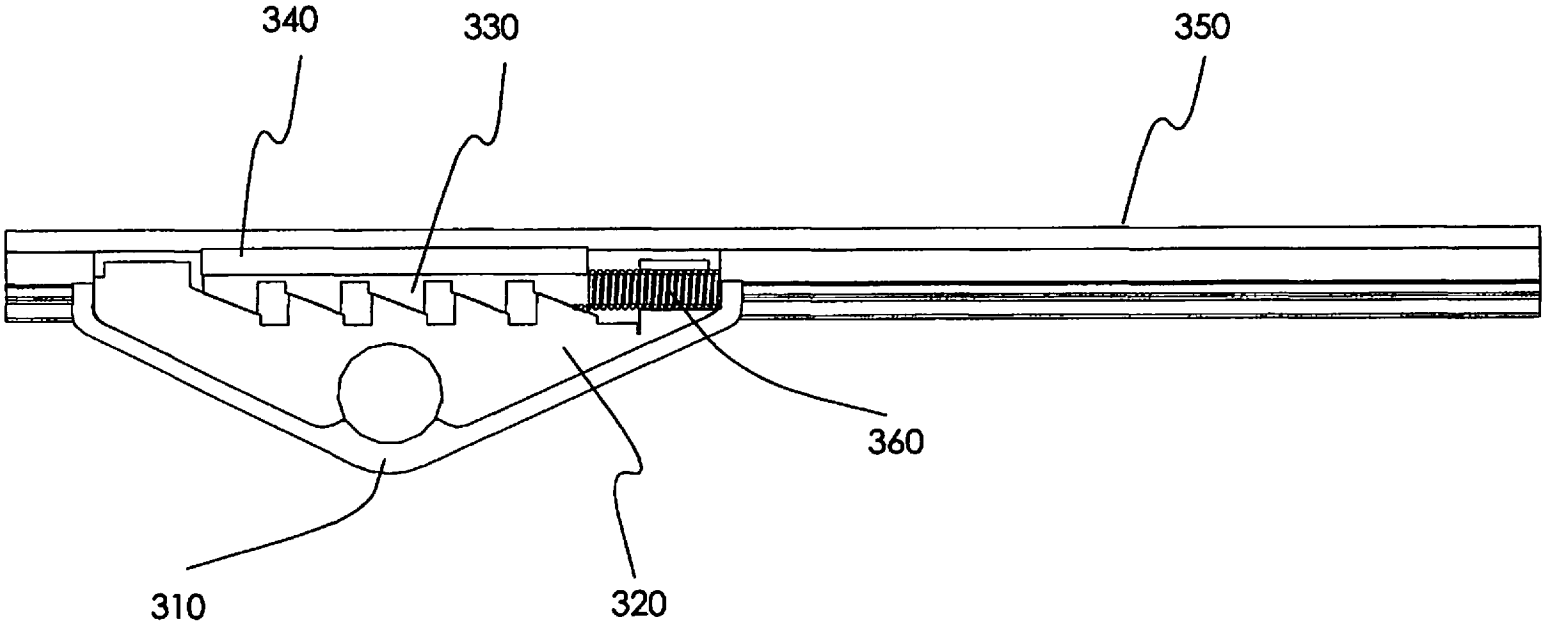
FIG. 12 is a partial cutaway side elevation of an embodiment of the bracket when the chair is in the rested position.

Referring to the orientation of the bracket 300 as shown in FIG. 11, one or more wedges of friction pad 335 are slidably engaged to one or more wedges of the top portion 321. The friction pad 335 is capable of transverse movement within the top portion's cavity when engaged. As demonstrated in FIG. 11, the one or more wedges of friction pad 335 slide up the one or more wedges of the top portion 321 when the friction pad 335 moves to the left, thereby causing the friction pad 335 to elevate. Conversely, as demonstrated in FIG. 12, the one or more wedges of friction pad 335 slide down the one or more wedges of the top portion 321 when the friction pad 335 moves to the right, thereby causing the friction pad 335 to lower. As shown in FIGS. 9-12, the bracket 300 can further comprise a biasing means 360. The biasing means, such as a spring or a pneumatic cylinder, can exert an axial force on the friction pad 335 such that the friction pad 335 is biased into an elevated position.

The friction pad 335 can be constructed out of material similar to that used in automotive brake pads, such as semi-metallic compounds, ceramic compounds, organic compounds, fiberglass, Kevlar or carbon fiber. The friction pad 335 can also be constructed out of rubber, polymers (i.e., plastics), or any other suitable friction-inducing material. The friction pad 335 can comprise an upper portion 340 and a lower portion 330, with the lower portion 330 being constructed out of a polymer such as plastic and the upper portion 340 being constructed out of the friction inducing material described above. In another embodiment, the friction pad 335 can be constructed as a single piece.

The bottom surface of seat 23 can feature a track 350. The track 350 can be attached to the seat 23 by any suitable means known in the art. Bracket 300 can be slidably engaged with the retaining track 350 such that the track 350 engages the friction pad 335 as chair 1 moves between the rested position and the reclined position. As shown in the embodiment depicted in FIGS. 11 and 12, the friction between the friction pad 335 and the track 350 can cause the friction pad 335 to slide slightly upward and to the left as the bracket 300 is moved from the position shown in FIG. 12 (rested position) to the position shown in FIG. 11 (reclined position). This upward movement causes friction pad 335 to exert greater force, and therefore a greater friction on the track 350 when the bracket 300 is moved from the position shown in FIG. 12 to the position shown in FIG. 11. In an embodiment, the biasing means 360 can bias the friction pad 335 into an elevated position, thus causing the friction pad 335 to maintain constant contact with the track 350, including when the bracket 300 is moved from the position shown in FIG. 12 to the position shown in FIG. 11, and/or from the position shown in FIG. 11 to the position shown in FIG. 12. In an embodiment, the track 350 can be connected to the seat 23 and the bracket 300 can be connected to the frame. In such an embodiment, when the chair is moved from the rested position to the reclined position, the friction between the friction pad 335 and the track 350 will be greater than when the chair is moved from the reclined position to the rested position.

In another embodiment, as opposed to the track 350 being connected to the seat and the bracket 300 being connected to the frame, the bracket 300 can be connected to the seat 23 and the track 350 can be connected to the frame. In yet another embodiment, the bracket and the track can be located at any other position whereby frictional resistance is exerted when the chair is moved from the rested position to the reclined position and/or from the reclined position to the rested position. For example, the bracket and the track could be modified and located in or about pivot point 24 (shown in FIG. 6) and/or upper pivot point 13, such that friction between the friction pad and the track resists rotation of the back about pivot point 24 and/or upper pivot point 13. In such an embodiment, the track and the friction pad can each have a complimentary curvature that allows the bracket to slidably rotate in an arc relative to the track. In each of these embodiments, the friction between the track and the friction pad can cause the friction pad to slide slightly up the wedges as the chair is moved from the rested position to the reclined position. Since the upward movement of the friction pad on the wedges causes the friction pad to exert greater force on the track, when the chair is moved from the rested position to the reclined position the friction between the friction pad and the track can be greater than when the chair is moved from the reclined position to the rested position.

In the embodiments shown in FIGS. 8 through 12, the track 350 has a generally "C" shaped cross-sectional profile and has flanges that retain the bracket 300 as the bracket 300 slides within the track 350. In another embodiment the track 350 can be other shapes. For example, in an embodiment the flanges can be eliminated and the track can be substantially flat. In such an embodiment, the bracket would not slide within the track and would instead simply slide against the track.

Referring now to FIG. 1, an embodiment of the invention can be configured as follows. The right front leg portion 43 rotatably engages the back 11 by insertion into the right pivot recess 12. Back 11, therefore, rotates relative to the right front leg portion 43 about the upper pivot point 13 at the right pivot recess 12. The pivotal connection between the pivot recess 12 and the right front leg portion 43 may be secured by any suitable manner. The right front leg portion 43 curves downward from the upper pivot point 13. The right front leg portion 43 is contiguous (i.e., connecting without break) to the right base portion 42, and the right base portion 42 is contiguous with the right rear leg 41 portion, such that a generally U-shaped base support is formed. The right rear leg portion 41 is contiguous to the central portion 44. The central portion 44 is contiguous to the left frame portion 100, with the subcomponents of the left frame portion being constructed symmetrically from the right side as described herein.

Front seat supports, such as a protrusion 21 or a bracket 300, can be rotatably engaged to the front leg portions 43 such that the bottom surface of the seat 23 may slide forward or rearward upon the front seat supports, which can remain in a substantially horizontal position despite forward or rearward movement by the right front leg portions 43. In another embodiment, a cross-bar can be connected between the right front leg portion 43 and the left front leg portion 43 such that the seat 23 slidably engages the cross-bar.

The frame 40 can function as a spring. FIG. 1 depicts the frame in a rested position. When the frame 40 is in the rested position, the spring is "unloaded." FIG. 2 depicts the frame 40 in a reclined position. When the frame 40 is in the reclined position, the spring is "loaded." Although FIG. 1 depicts the spring as unloaded when the frame 40 is in the rested position, in an embodiment the chair can be constructed or otherwise formed such that the spring is slightly loaded even when the frame 40 is in the rested position.

In operation, the user can recline the chair 1 by pushing rearwardly upon the back 11. The back 11 rotates about the upper pivot point 13, such that the upper portion 111 rotates rearward and the lower portion 112 rotates forward to provide lumbar support to the user as the user reclines. Contemporaneously, the armrest sections 47 of the front leg portions 43 move both rearward and downward as the user pushes rearwardly upon the back 11. The rearward and downward movement of the armrest sections 47 is transmitted to the contiguous support sections 48, causing the support sections 48 of the front leg portions 43 to deflect as they are pulled rearward. Contemporaneously, and because the lower portion 112 of the back has rotated forward, the connector 30 (which is connected to the lower portion 112) moves forward. The connector 30 transfers the forward force to the seat 23 and the frame 40 through the pivot point 24 (shown in FIG. 6). As the seat 23 moves forward, the bottom surface of the seat 23 slides along the front seat supports. Meanwhile, the forward force is transferred to the frame via the central portion 44 of the frame. The central portion 44 is contiguous with the rear leg portions 41. Thus, the rear leg portions 41 are pushed in a forward direction, causing the rear leg portions 41 to deflect.

In response to the front leg portions 43 moving/flexing rearward and rear leg portions 41 moving/flexing forward, the base portion 42 deflects downward. As shown in FIGS. 1-2 and 6-7, feet 62 can be attached to the base portion 42 so as to allow the base portion 42 to deflect downward. In another embodiment as depicted in FIGS. 3-5, base portion 42 can feature an upward curvature, such that when front leg portion 43 moves/flexes rearward and rear leg portion 41 moves/flexes forward, the base portion 42 may deflect downward to accommodate the movement.

Because the front leg portions 43 and rear leg portions 41 are moved inward (i.e., the front leg portions 43 are moved rearward, the rear leg portions 41 are moved forward), the seat's height is lowered, thereby shifting the center of gravity of the user downward. The deflection experienced in the front and rear leg portions also aids in lowering the seat height. In an embodiment, the chair can recline to and/or past the point where the back 11 is in generally the same plane as the seat 23.

The center of gravity with respect to forward and rearward movement is generally static when frame 40 is brought from the rested position to the reclined position. When the frame 40 is in the rested position, the user's center of gravity is generally centered between the front leg portions 43 and rear leg portions 41. In the embodiment depicted in FIG. 2, the seat 23 slides forward and the back 11 moved reward when the chair 1 is in the reclined position. As a user reclines in the chair, the forward movement of the user's lower body is generally balanced by the reward movement of the user's upper body. As a result, the center of gravity with respect to forward and rearward movement remains generally static, thereby reducing tipping of the chair in the reclined position.

A user's weight is transferred from the seat to the frame through the front seat supports, thereby making the degree of frictional resistance exerted by the front seat supports correlative to the weight of the user. Because the force required to slide the seat 23 is dependent on the user's weight, the reclining function of chair 1 will self-adjust from user to user. For example, a 250 lb. (113.4 kilogram) man will have to exert a greater rearward force on the back than a 150 lb. (68.04 kilogram) man to overcome the frictional resistance provided by the front seat support on the sliding of the seat 23.

The frame 40 will automatically return to the rested position once the rearward force being applied to the back 11 by the user is removed. As previously noted, the frame 40 is comprised of a resiliently flexible material and functions as a spring. Accordingly, the chair 1 is biased into the rested position by the resiliently flexible frame 40. When the rearward force being applied to the back 11 is removed, the frame 40, acting as a spring, will unload, thereby returning to the rested position. In other words, the frame will bias the seat rearward, the upper back portion rotationally forward, and the lower back portion rotationally rearward.

In an embodiment, chair 1 can also comprise a means for ganging chairs to one another, such as chair 1 having a hook member on the left frame portion and a hook receiving member on the right frame portion. In another embodiment, a stabilizer bar 49 can connect the left and right front legs 43 and can provide more stability to chair 1.

Referring now to the embodiment shown in FIGS. 3 and 4, a different configuration of the frame 40 is shown. The frame portions 100 still have front leg portions 43, base portions 42, and rear leg portions 41. However, in this embodiment, the front leg portions 43 travel below the seat 23 in order to rotatably engage the back 11. The armrest section 47 of the front leg portion 43 is replaced in this embodiment with a terminal section 45 and a seat section 46. In this configuration, chair 1 can be telescopically stackable when the left and right frame portions 100 are tapered.

Referring now to FIG. 4, an embodiment of the invention can be configured as follows. The right front leg portion 43 is contiguous to the right base portion 42, and the right base portion 42 is contiguous with the right rear leg 41 portion, such that a generally U-shaped base support is formed. The right rear leg portion 41 is contiguous to the central portion 44 (shown in FIG. 3). The central portion 44 is contiguous to the left frame portion 100, with the sub-components of the left frame portion being constructed symmetrically from the right side as described herein. The left and right front leg portions 43 further comprises terminal sections 45, seat sections 46, and support sections 48. The right terminal section 45 of the right front leg portion 43 rotatably engages the back 11 by insertion into the right pivot recess 12. Back 11, therefore, rotates relative to the right front leg portion 43 about the upper pivot point 13 at the right pivot recess 12. The pivotal connection between the pivot recess 12 and the right front leg portion 43 may be secured by any suitable manner.

In operation, the frame 40 functions as a spring to return the back 11 and the seat 23 to resting positions after reclining by a user. When a user sits in the chair 1, the user can recline the chair 1 by pushing rearwardly upon the back 11. The back 11 rotates about the upper pivot point 13, such that the upper portion 111 rotates rearward and the lower portion 112 rotates forward to provide lumbar support to the user as the user reclines.

Contemporaneously, the terminal sections 45 of the front leg portions 43 move both rearward and downward as the user pushes rearwardly upon the back 11. The rearward and downward movement of terminal sections 45 is transmitted to the seat sections 46 of the front leg portions 43, causing the seat section 46 to move rearward and downward. Meanwhile, the rearward force is transferred through the seat sections 46 to the support sections 48, causing the support sections 48 of the front leg portions 43 to deflect as they are pulled rearward.

Also contemporaneously, and because the lower portion 112 of the back 11 has moved forward, the connector 30 (which is connected to the lower portion 112) moves forward. The connector 30 transfers the forward force to the seat 23 and the frame 40 through the pivot point 24. As the seat 23 moves forward, the bottom surface of the seat 23 slides along the front seat support. Meanwhile, the forward force is transferred to the frame via the central portion 44 of the frame. The central portion 44 is contiguous with the rear leg portions 41. Thus, the rear leg portions 41 are pushed in a forward direction, causing the rear legs to deflect. Moreover, in response to the support sections 48 of the front leg portions 43 moving/flexing rearward and rear leg portions 41 moving/flexing forward, the base portion 42 deflects downward.

Referring now to the embodiment shown in FIG. 6, a cantilevered configuration for frame 40 is shown. In this embodiment, the frame 40 comprises left and right front leg portions 43 and a cantilevered base portion 52 contiguous to the left and right front leg portions 43. The left and right front leg portions 43 further comprise armrest sections 47 and support sections 48. The armrest sections 47 of the left and right front leg portions 43 are rotatably engaged to the back 11 at upper pivot point 13 by insertion into the left and right pivot recesses 12, as described above. The connector 30 is fixed to the back 11 and is rotatably engaged to the rear of the seat at seat pivot point 24. A cross bar 53 can be mounted between the left and right front leg portions 43, and the bottom surface of the seat 23 slidably engages the cross-bar 53. A means 54 for biasing the seat 23 into the rested position can attach the bottom surface of the seat 23 to the cross-bar 53 such that the seat 23 returns to the resting position once the rearward force being applied to the back 11 by the user is removed. The biasing means can be a spring, a pneumatic or hydraulic cylinder, an elastic material, a motor, or any other suitable element capable of exerting a force on the seat 23. The biasing means can also be a spring, such as a spring-loaded hinge, engaged between the seat 23 and the back 11, such as at seat pivot point 24.

In operation, as shown in the embodiment depicted in FIG. 7, the biasing means 54 returns the back 11 and the seat 23 to resting positions after reclining by a user. Accordingly, when a user sits in the chair 1, the user can recline the chair 1 by pushing rearward upon the back 11. The back 11 rotates about the upper pivot point 13, such that the upper portion 111 rotates rearward and the lower portion 112 rotates forward to provide lumbar support to the user as the user reclines. Contemporaneously, and because the lower portion 112 of the back 11 has rotated forward, the connector 30 (which is connected to the lower portion 112) moves forward. The connector 30 transfers the forward force to the seat 23 and the frame 40 through the pivot point 24. As the seat 23 moves forward, the bottom surface of the seat 23 slides along cross bar 53, "loading" the biasing means 54. In this manner, the back 11 has moved rearward and downward under the reclining force, and the seat 23 has moved forward also as a result of the reclining force.

Contemporaneously, the terminal sections 45 of the left and right front leg portions 43 move both rearward and downward as the user pushes rearwardly upon the back 11. The rearward and downward movement of terminal sections 45 is transmitted to the support sections 48, causing the support sections 48 of the front leg portions 43 to deflect as they're pulled rearward.

The force applied by the user to recline the chair 1 varies with the weight of the user. The cross-bar 53 provides frictional resistance to the sliding of the seat 23 such that the force required to recline the chair will vary from user to user, and the chair will self-adjust. The embodiment shown in FIGS. 6 and 7 can utilize the front seat supports described above (i.e., the protrusions 21 or brackets 300).

One of skill in the art of chair manufacture should appreciate that the embodiments described herein could be applied to a pedestal chair as well. In such embodiments, the frame 40 could be mounted to the pedestal to provide resilient flexibility to provide elastic engagement of the seat 23 to the frame, or the seat 23 may be elastically restrained to the pedestal by a spring element similar to the embodiment shown in FIGS. 6 and 7. Further, although the figures show certain embodiments with armrests and other embodiments without armrests, it should be appreciated that each of the embodiments can have armrests.

The embodiments shown in the drawings and described above are exemplary of numerous embodiments that may be made within the scope of the appended claims. It is contemplated that numerous other configurations may be used, and the material of each component may be selected from numerous materials other than those specifically disclosed. In short, it is the applicant's intention that the scope of the patent issuing here from will be limited only by the scope of the appended claims.

I claim:

1. A chair, comprising:

a frame assembly including a left and a right frame portion, each said frame portion including a front leg, a base leg, and a rear leg;

a seat support attached to each said front leg;

a seat having a front portion slidably disposed on each said seat support and a back portion rotatably coupled to an upper end of each rear leg;

a chair back having an upper portion rotatably coupled to an upper end of each front leg, and a lower portion rotatably interconnected to said upper end of each rear leg;

wherein as a user leans back in the chair, said chair back reclines moving each front leg of the frame assembly toward said rear legs placing said front legs in tension, and said seat translates forward over said seat supports attached to said front legs, moving said upper ends of said rear legs toward said front legs placing said rear legs in tension, elastically deforming each of said frame portions and storing energy, and wherein the stored energy aids the user to sit upright by forcing said rear legs to move backward translating said seat toward said chair back, and said front legs to move forward bringing the chair back forward and to an upright position.

2. The chair of claim 1, further comprising a connector fixedly connected to the back, the connector being rotatably engaged to the seat.

3. The chair of claim 1, wherein said left and right frame portions each include a contiguous member.

4. The chair of claim 1, wherein said front seat support comprises a portion of said front leg formed to provide a shelf receiving said seat thereon in sliding engagement.

5. The chair of claim 1, wherein each said left and right frame portion functions as a spring.

6. The chair of claim 1, wherein said bias applied to said back portion of said seat toward a rear of said chair rotates said back about said intermediate point to rotate said back about said intermediate point such that said lower back portion rotates rearward and said upper back portion rotates forward.

7. The chair of claim 1, wherein the chair is telescopically stackable with another chair.

8. A chair comprising: a resiliently flexible frame assembly formed by a left and a right frame member, each frame member formed from a contiguous length of material to define a front leg portion, a base portion, and a rear leg portion, all preloaded to function as a spring, each front leg portion including a front seat support and each rear leg portion including a back seat support; a seat assembly slidably disposed on said front seat supports, including a back end coupled to each said back seat support; and a back assembly including an upper portion rotatably interconnected to and upper end of said front leg portion and a lower portion rotatably interconnected to said back end of said seat assembly; wherein said front leg portion and said rear leg portion of each frame member are placed in compression and move toward one another when a user reclines tilting said back assembly toward the rear of the chair, and translating said seat assembly toward the front of the chair, storing energy in each frame member, the stored energy aiding the user to return to an upright position by forcing each front leg portion and said rear leg portion away from one another to move the back assembly to an upright position and translate the seat assembly toward the rear of the chair.

9. The chair of claim 8, wherein said base portion of each said frame member includes an upward curvature.

10. The chair of claim 8, wherein each rear leg portion of each left and right frame member biases the seat member rearward, and biases the lower portion of the back member away from the chair.

11. The chair of claim 8, wherein a rearward force applied to said upper portion of said back member rotates said back member about a pivot point defined by the upper end of said front leg portion, such that the lower portion of said back member rotates forward, sliding the seat forward along the front seat supports.

12. The chair of claim 8 further comprising a connector rotatably engaging said back to said seat.

13. A reclining chair, comprising:

a sled base including a left frame portion and a right frame portion interconnected to one another, each frame portion formed from a continuous resiliently flexible material defining a front leg portion, a rear leg portion and an intermediate base portion interconnecting said front leg portion and said rear leg portion, each frame portion functioning as a spring absorbing energy when deformed and releasing energy when unloaded;

a seat slidably disposed on said front leg portions of said sled base and connected to an upper end of said rear leg portions along a back portion of said seat;

a chair back having an upper portion pivotally connected to an upper end of said front leg portions and a lower portion of said chair back pivotally interconnected to said back portion of said seat;

wherein application of a rearward force upon said upper portion of said chair back causes said lower portion of said chair back connected to said seat to move in an opposing direction translating said seat relative to said sled base and moving said upper ends of said front and rear leg portions towards one another placing each frame portion in compression, and a release of said rearward force upon said upper portion of said chair back unloads said upper ends of said front and rear leg portions resulting in said chair back to return to an upright position and translate said rearward to their original positions.

14. A reclining chair having a seat bottom and a seat back interconnected together proximate an upper end of a resilient rear leg assembly, and a resilient front leg assembly supporting a forward edge of the seat bottom and connected at an upper end to the seat back, wherein upon a user reclining in the reclining chair, opposing forces are applied to said front and rear leg assemblies causing said front and rear leg assemblies to move toward one another and storing energy therein, and wherein the user sits upright in the reclining chair, the energy stored in the front and rear leg assemblies biases the front and rear leg assemblies apart from one another in opposite directions wherein the rear leg assembly moves the seat bottom back to its original position and the front leg assembly moves the seat back to its original position.

15. A reclining chair having a sliding seat bottom interconnected to a tilting seat back at an upper end of a resilient rear leg assembly, a resilient front leg assembly supporting a forward portion of the seat bottom and pivotally interconnected to an upper portion of the seat back, the front leg assembly and the rear leg assembly interconnected to one another by an intermediate base portion, wherein a static and upright configuration the seat bottom is positioned toward the rear of the chair by the rear leg assembly and the seat back is positioned upright by the front leg assembly, and wherein in a reclined position, the seat bottom slides toward the front of the chair and the seat back tilts toward the back of the chair about the connection between the sliding seat bottom and the tilting back, placing the front and rear leg assemblies in compression toward one another and storing energy that returns the reclining chair to the static position.

* * * * *